US007571907B2

(12) United States Patent
Shinyama

(10) Patent No.: US 7,571,907 B2
(45) Date of Patent: Aug. 11, 2009

(54) DRIVING APPARATUS

(75) Inventor: Hideki Shinyama, Tokyo (JP)

(73) Assignee: Oki Data Corporation, Tokyo (JP)

( * ) Notice: Subject to any disclaimer, the term of this patent is extended or adjusted under 35 U.S.C. 154(b) by 369 days.

(21) Appl. No.: 11/378,862

(22) Filed: Mar. 17, 2006

(65) Prior Publication Data

US 2006/0209156 A1 Sep. 21, 2006

(30) Foreign Application Priority Data

Mar. 18, 2005 (JP) ..... 2005-078410

(51) Int. Cl.
*B65H 5/02* (2006.01)
*B65H 9/04* (2006.01)

(52) U.S. Cl. ..... 271/242; 271/272; 271/264; 271/114; 271/314; 318/685; 318/696

(58) Field of Classification Search ..... 271/114, 271/10.13, 10.12, 115, 226, 227, 242, 266, 271/270, 264, 272, 314, 275; 318/685, 696
See application file for complete search history.

(56) References Cited

U.S. PATENT DOCUMENTS 5,967,506 A * 10/1999 Miki et al. ..... 271/10.13
6,092,803 A * 7/2000 Munenaka ..... 271/242
6,733,009 B2 * 5/2004 Ogasawara ..... 271/265.01

FOREIGN PATENT DOCUMENTS

JP 10-30653 A 2/1998

* cited by examiner

*Primary Examiner*—Patrick H Mackey
*Assistant Examiner*—Luis Gonzalez
(74) *Attorney, Agent, or Firm*—Panitch Schwarze Belisario & Nadel LLP

(57) ABSTRACT

In a driving apparatus, a drive force interruption/transmission device transmits or interrupts a drive force from a drive source, a load unit is operated by the drive force transmitted from the drive force interruption/transmission device, a torque control unit varies the output torque of the drive source, a drive force interruption control unit controls the operation of the drive force interruption/transmission device, and a drive timing control unit for controls the torque control unit and the drive force interruption/transmission control unit. After the output torque of the drive force is increased the drive force from the drive source is transmitted to the load unit.

7 Claims, 12 Drawing Sheets

DRIVING APPARATUS

BACKGROUND OF THE INVENTION

1. Field of the Invention

The present invention relates to a driving apparatus.

2. Description of the Related Art

In a conventional image forming apparatus such as a printer, a driving apparatus is used to transmit a driving force generated by a drive source such as a motor, by means of a driving means, such as gears, for driving a roller or the like, for feeding or conveying a recording medium such as a printing paper. In such a driving apparatus, a clutch is used as a means for transmitting and interrupting a driving force, to connect a roller or the like, as a load unit, to the drive source, and, while the drive source is kept rotating, the clutch is operated to transmit the driving force to the roller or the like. See for example in Japanese Patent Kokai Publication No. H10-30653.

In the conventional driving apparatus, when the clutch is operated to cause transition from the interrupting state to a transmitting state, to connect the drive source and the roller or the like, the drive source receive a high load, because of the inertia of the roller or the like. To prevent damages to the drive source due to the high load, it is necessary to keep the drive source rotating, such that a sufficient torque to withstand such a high load is generated. However, if the drive source is kept rotating such that a sufficient torque is obtained, power consumption of the drive source is increased, or the drive source may be heated excessively, and the temperature within the image forming apparatus may rise too high.

SUMMARY OF THE INVENTION

An object of the present invention is to solve the above problems and to provide a driving apparatus which can reduce the power consumption and the heat generation.

A driving apparatus according to the present invention comprises:

(a) a drive source outputting a drive force;

(b) a drive force interruption/transmission device for transmitting or interrupting the drive force from the drive source;

(c) a load unit operating by the drive force transmitted from the drive force interruption/transmission device;

(d) a torque control unit for varying the output torque of the drive source;

(e) a drive force interruption control unit for controlling the operation of the drive force interruption/transmission device; and (f) a drive timing control unit for controlling the torque control unit and the drive force interruption/transmission control unit;

(g) wherein after the output torque of the drive force is increased the drive force from the drive source is transmitted to the load unit.

According to the present invention, the output torque of the drive source increased before the driving force interruption/transmission device is operated, and the driving force is transmitted to the load unit, so that the power consumption of the drive source and heating, and the like can be reduced.

DETAILED DESCRIPTION OF THE INVENTION

Embodiments of the invention will now be described with reference to the attached drawings.

Figure 2:
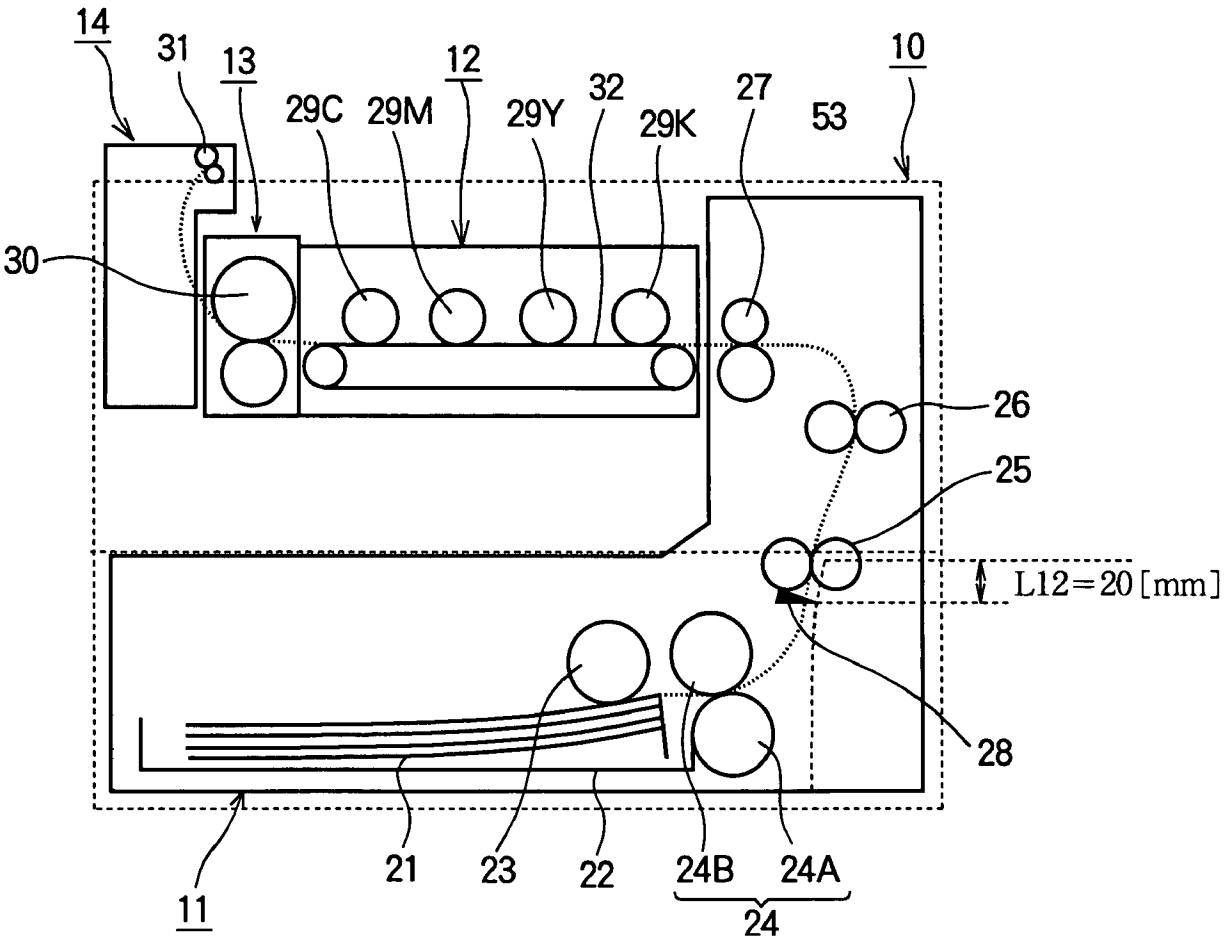
FIG. 2 is a schematic diagram of an image forming apparatus according to the first embodiment of the invention.

FIG. 2 shows an image forming apparatus according to a first embodiment of the invention. Reference numeral 10 denotes a printer, which is one type of image forming apparatus. The invention is applicable to any type of image forming apparatus, including a monochromatic electro-photographic printer, a facsimile machine, a copier, a multi-function printer also having functions of a facsimile machine, and a copier. In the description of the embodiments, the image forming apparatus is assumed to be a tandem color electro-photographic printer. In this case, the printer 10 comprises a sheet feeding unit 11, a toner image forming unit 12, a fixing unit 13, and a sheet discharge unit 14, and an image is formed on a recording medium which is conveyed by a rotating belt member passing over stretched about a plurality of rollers.

The sheet feeding unit 11 has a sheet cassette 22, a pick-up roller 23, a sheet separating unit 24, a first or primary conveying roller pair 25, a second or an intermediate conveying roller pair 26, and a registration roller pair 27.

The sheet cassette 22 accommodates a plurality of stacked recording paper sheets 21 as a printing medium.

The pick-up roller 23 picks up and feeds out the paper sheets 21 one by one from the sheet cassette 22.

The separating unit 24 comprises a retard roller 24A and a feed roller 24B, for separating the recording paper sheets 21 overlapping each other when they are fed out from the pick-up roller 23, into each sheet.

The conveying roller pair 25 and the intermediate conveying roller pair 26 serve to convey the paper sheet 21, and to correct any skew of the paper sheet 21.

The registration roller pair 27 also corrects any skew of the paper sheet 21 immediately before the printing.

A conveyance sensor 28 is provided on a sheet conveyance path, immediately before (upstream of) the conveying roller pair 25, to detect the paper sheet 21.

The toner image forming unit 12 is provided with a sheet conveying belt 32 for conveying the paper sheet 21 fed from the sheet feeding unit 11, and black, yellow, magenta and cyan image forming units 29K, 29Y, 29M and 29C for forming toner images on the paper sheet 21. In the present embodiment, the printer 10 is a color printer, and black, yellow, magenta and cyan image forming units 29K, 29Y, 29M and 29C are provided to form toner images of black, yellow, magenta, and cyan.

A fixing roller pair 30 is provided to fix the toner images having been formed by the black, yellow, magenta and cyan image forming units 29K, 29Y, 29M and 29C, onto the paper sheet 21. By application of heat and pressure, the toner of the toner images attached to the paper sheet 21 is fused, pressed, and fixed on the paper sheet 21.

The sheet discharge unit 14 is provided with a discharge roller 31 for discharging or ejecting the paper sheet 21, on which the toner images have been fixed at the fixing unit 13. The paper sheet 21 having been discharged is placed on a discharging tray, not shown as such, provided on top of the image forming apparatus.

The configuration of the driving apparatus will next be described. Here, it is assumed that the conveying roller pair 25 forms a load unit 43.

Figure 3:
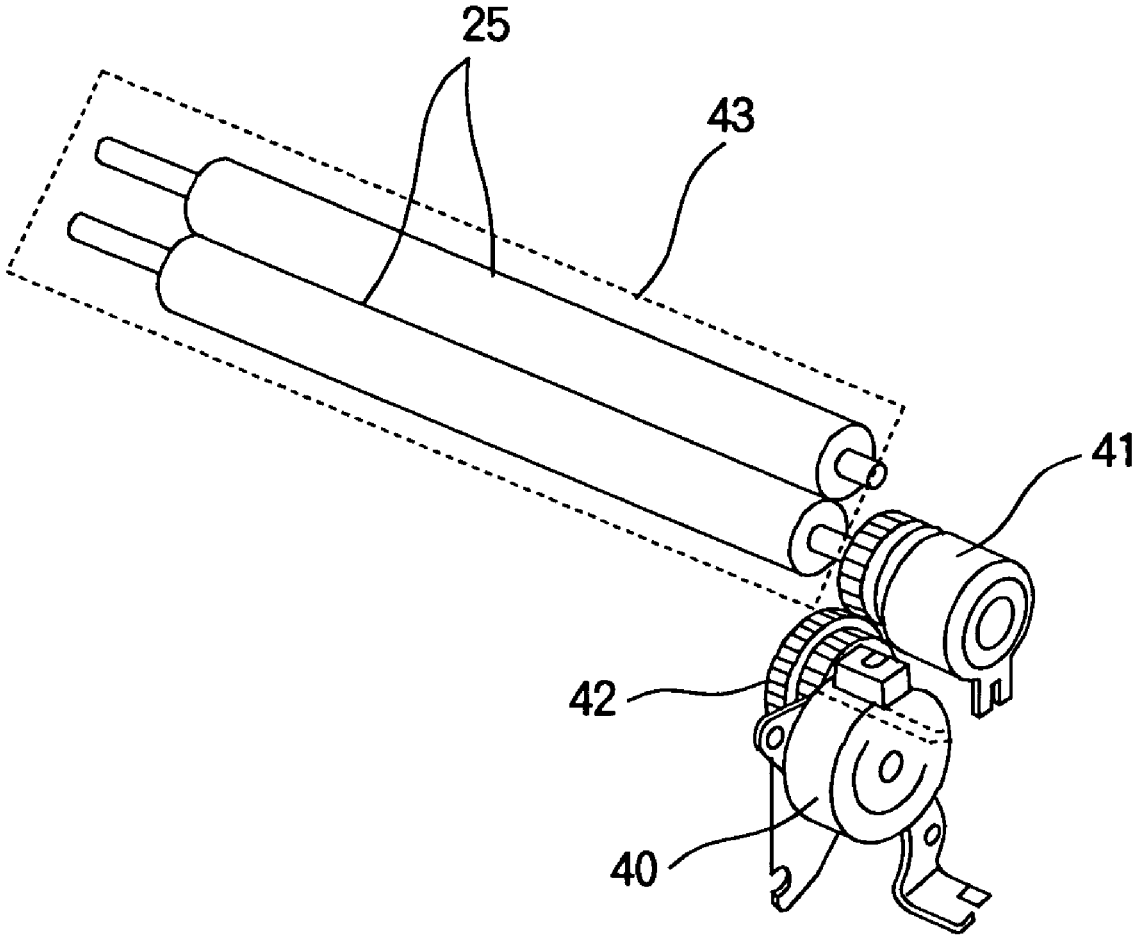
FIG. 3 is a perspective view of a part of the image forming apparatus according to the first embodiment of the invention.

FIG. 3 is a perspective view showing the driving apparatus according to the first embodiment of the invention.

A motor unit 40 serving as a drive source is mounted to a frame, not shown, of the printer 10. The motor unit 40 is in the form of a stepping motor, and outputs a driving force, which is transmitted via gears 42, to an electro-magnetic clutch 41 which serves as a means for selectively interrupting or transmitting the driving force.

The load unit 43 for the driving apparatus is a medium conveying device for conveying the paper sheet 21 in the printer 21. In the example shown in FIG. 3, the load unit 43 consists of the conveying roller pair 25, as mentioned above. The driving force of the motor unit 40 is transmitted via the gears 42 and the electro-magnetic clutch 41 to the conveying roller pair 25. The interruption or transmission of the driving force is achieved by operating the electro-magnetic clutch 41. That is, when the electro-magnetic clutch 41 is in a connecting (or transmitting) state, the driving force of the motor unit 40 is transmitted to the conveying roller pair 25. When the electro-magnetic clutch 41 is in a disconnecting (or interrupting) states the driving force of the motor unit 40 is not transmitted to the conveying roller pair 25.

A control device for the driving apparatus according the present embodiment will next be described.

Figure 1:
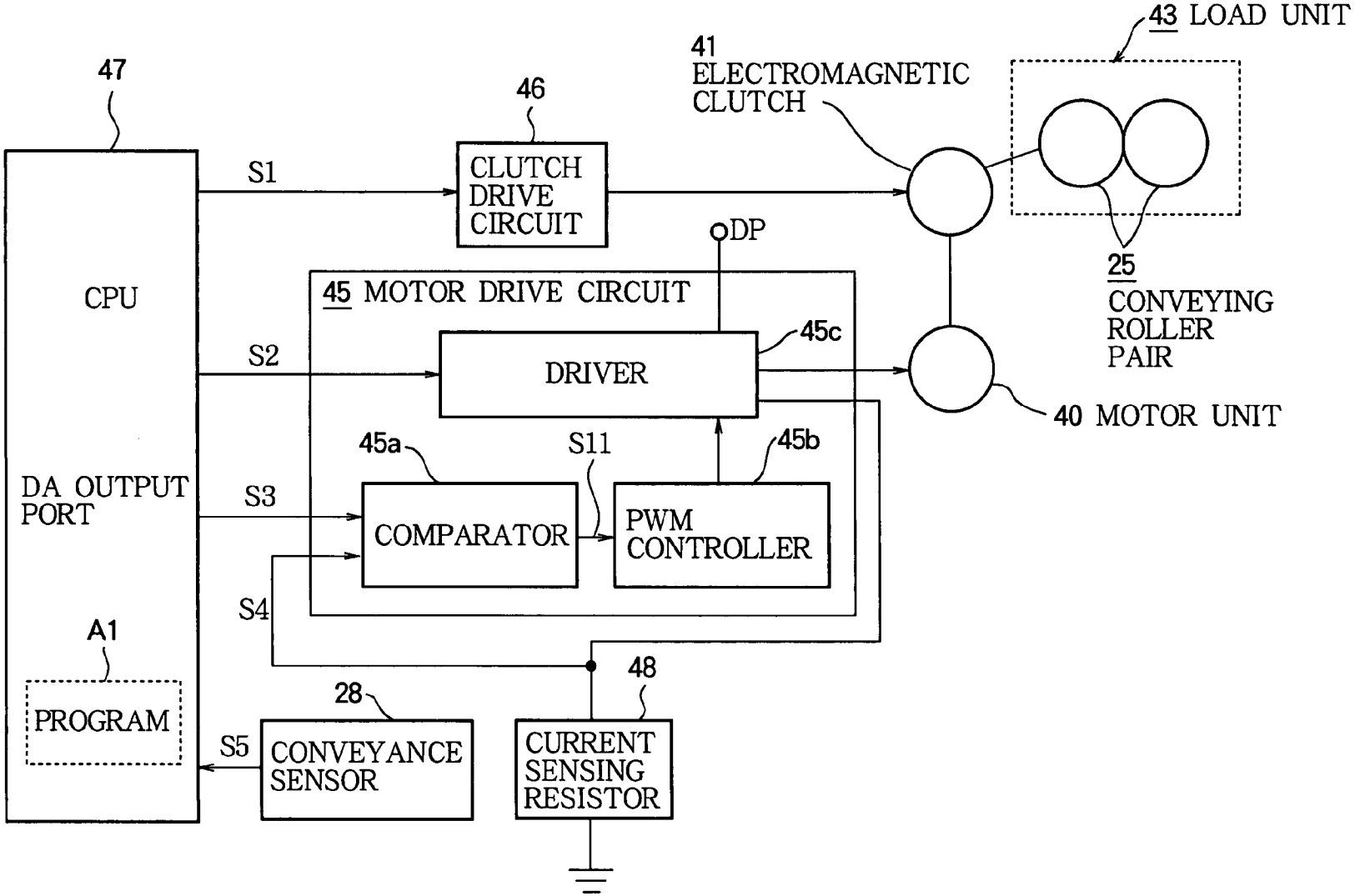
FIG. 1 is a block diagram of a control device of a driving apparatus of a first embodiment of the invention.

FIG. 1 is a block diagram showing the configuration of the control device of the driving apparatus according to the first embodiment of the invention.

The driving apparatus according to the present embodiment comprises a motor drive circuit 45, a clutch drive circuit 46 and a CPU 47.

The motor drive circuit 45 is a torque control circuit for controlling the motor unit 40, and serves as a means for switching a drive current.

The clutch drive circuit 46 serves as a driving force interruption/transmission control unit for controlling the electromagnetic clutch 41.

The CPU 47 performs control over the entire driving apparatus, including control over timing of operation of the clutch drive circuit 46 and the motor drive circuit 45. Specifically, the CPU 47 serves as a drive timing control unit for controlling the timing of operation, including the starting timing, of the motor drive circuit 45, and for controlling the motor current.

The motor drive circuit 45 is provided with a current sensing resistor 48 for sensing the drive current of the motor unit 40.

The CUP 47 operates according a program A1 stored therein (i.e., in a program memory not shown as such), and conducts control over the driving apparatus, i.e., drive control. Control signals from the CPU 47 and supplied to the motor drive circuit 45 include a phase signal S2 for controlling the excitation phase of the motor unit 40, and a voltage signal S3 for controlling the motor current value. The voltage signal S3 is output from a DA output port of the CPU 47. Supplied from the CPU 47 to the clutch drive circuit 46 as a control signal is a clutch ON/OFF signal S1, and a motor current sensing signal S4 is input from the current sensing resistor 48. An output signal S5 of the conveyance sensor 28 is input to the CPU 47.

As the motor drive circuit 45, a stepping motor driver of a bipolar drive type, such as MTD 2005F manufactured by Shindengen Electric Manufacturing Co., Ltd., TA84002 manufactured by Toshiba Corporation, may be used. The motor drive circuit 45 includes, as functional blocks, a comparator 45*a* for comparing the voltages, a PWM controller 45*b* for varying the PWM (pulse-width modulation) duties based on the result of the comparison at the comparator 45*a*, and a driver 45*c* for turning on and off the currents. The driver 45*c* receives a power supply from a drive power source voltage terminal DP.

The clutch drive circuit 46 supplies or interrupts the voltage to the electromagnetic clutch 41, and may be formed of transistor circuits. When the clutch ON/OFF signal S1 is "high," the electromagnetic clutch is engaged or on. When the clutch ON/OFF signal S1 is "low," the electromagnetic clutch is disengaged or off.

The operation of the driving apparatus of the above configuration will now be described.

The conveying operation for conveying the paper sheet 21 during printing is first described.

The paper sheets 21 accommodated in the sheet feeding unit 11 are picked up and fed out by the sheet pick-up roller 23 in the sheet feeding unit 11. When two or more paper sheets 21 are picked up simultaneously and fed out, overlapping each other, they are separated into each sheet by the separating unit 24. The paper sheet 21 is then conveyed toward the conveying roller pair 25. The conveying roller pair 25 is stationary (i.e., is not rotating) before the paper sheet 21 arrives at the position of the conveying roller pair 25. The conveying roller pair 25 starts to rotate when the paper sheet 21 travels a predetermined distance after the paper sheet 21 is detected by the sensor 28, i.e., when the paper sheet 21 abuts (is expected to abut) on the conveying roller pair 25. Any skew of the paper sheet 21 is thereby corrected. The present embodiment is directed to the driving apparatus which performs rotation and stopping of the conveying roller pair 25.

The paper sheet 21 is further conveyed by the intermediate conveying roller pair 26 and the registration roller pair 27 to the toner image forming unit 12. The toner image forming unit 12 forms toner images of black, yellow, magenta and cyan on the paper sheet 21 by means of the black, yellow, magenta and cyan image forming units 29K, 29Y, 29M and 29C, while conveying the paper sheet 21 by means of the sheet conveying belt 32.

The paper sheet 21 on which the toner images have been formed is conveyed to the fixing unit 13, where heat and pressure are applied by means of the pressure roller 30, so that the toner images are fixed on the paper sheet 21. The paper sheet 21 on which the toner images have been fixed is conveyed to the sheet discharge unit 14, where the paper sheet is discharged or ejected to the discharging tray on top of the printer.

The operation of the conveying roller pair 25 will now be described.

FIGS. 4A to 4D are time charts showing the operation of the driving apparatus according the first embodiment of the invention. The horizontal axes in FIGS. 4A to 4D represent time. However, the distances "L11," and "L13" are also shown along the horizontal axes. In such a case, their lengths along the horizontal axes are represented by the corresponding time lengths.

Figures 4A, 4B, 4C, 4D:
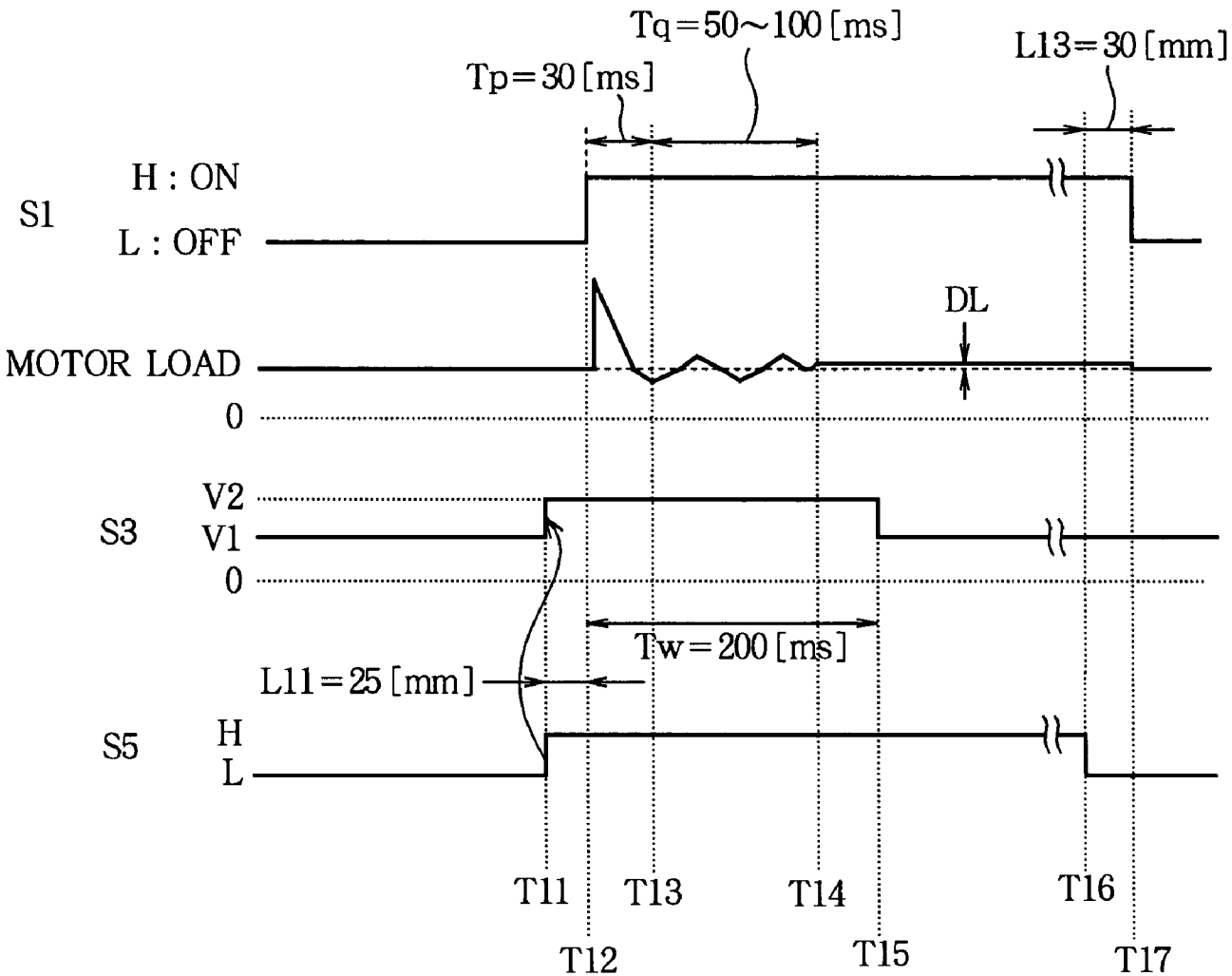
FIGS. 4A to 4D are time charts showing the operation of the driving apparatus according to the first embodiment of the invention.

Until the paper sheet 21 conveyed from the sheet feeding unit 11 reaches the position of the conveying roller pair 25, the electromagnetic clutch 41 is in the off state (as shown in FIG. 4D), and the conveying roller pair 25 is not rotating (FIG. 4A). However, the motor unit 41 is in the rotating state.

When the paper sheet 21 having been fed reaches the position of the conveyance sensor 28, and when the conveyance sensor 28 detects the leading edge of the paper sheet 21 (at time point T11), the CPU 47 raises the voltage of the current setting reference voltage signal S3, serving as the motor current setting signal, to a level V2 (as shown in FIG. 4C). A circuit for increasing the value of the drive current for the motor unit 40, i.e., the value of the motor current will be described later.

When the drive current value of the motor unit 40 is increased, the output torque increases suddenly, so that the rotation of the motor unit 40 becomes oscillatory. For this reason, when the load on the motor unit 40 increases at this timing, the motor unit 40 may be out of synchronization, and may pull out. It is therefore desirable that the electromagnetic clutch 41 is not turned on until after the oscillation of the motor unit 40, due to the increase of the drive current of the motor unit 40, is stabilized. Usually, the time Ts taken for the oscillation of the motor unit 40 to be stabilized is 50 to 100 ms.

In this embodiment, the result of the detection of the paper sheet 21 by the conveyance sensor 28 is utilized to simplify the control over timing at which the electromagnetic clutch 41 is turned on.

In the state in which the motor unit 40 is rotating, with an increased torque, the paper sheet 21 is conveyed further by the pick-up roller 23. At the time (T12) when the paper sheet 21 has traveled a distance of L11=25 mm which is a sum of the distance L12=20 mm (FIG. 2) from the detection position of the paper sheet 21 by the conveyance sensor 28 to the conveying roller pair 25 (see FIG. 2), and the amount of pressing to the conveying roller pair 25 (the distance of travel from the contact of the leading edge of the paper sheet with the conveying roller pair 25, till the paper sheet is completely gripped by the conveying roller pair 25) for correcting the skew of the paper sheet 21, the clutch ON/OFF signal S1 from the CPU 47 is set to be "high," so that the electromagnetic clutch 41 is turned on (at T12 as shown in FIG. 4A). When the electromagnetic clutch 41 is turned on, the conveying roller pair 25 begins to rotate, and the paper sheet 21 is conveyed to the toner image forming unit 12.

In the present embodiment, the conveying speed of the paper sheet 21 is Vc=180 mm/s, so that the time Tt required for the paper sheet to travel the distance of L11=25 mm is given by the following equation:

$$Tt=L11/Vc=25\ [\mathrm{mm}]/180\ [\mathrm{mm/s}]=139[\mathrm{ms}] \quad (1)$$

This value is larger than the time (Ts=50 to 100 ms) from the increase of the drive current value of the motor unit 40 till the stabilization of oscillation of the motor unit 40. It is therefore possible to turn on the electromagnetic clutch 41 after the rotation of the motor unit 40 is stabilized.

When the electromagnetic clutch 1 is turned on, as shown in FIG. 4A, i.e., when the motor unit 40 is connected with the load unit 43, the motor load (the load of the motor unit 40) increases suddenly, as shown in FIG. 4B. This is because of the inertia component of the load unit 43, and because the load unit 43 having been stationary begins to rotate and the rotation speed rises to the speed of the motor unit 40 within in a short period of time, upon turning-on of the electromagnetic clutch 41 and the resultant connection of the motor unit 40 with the load section 12. The high motor load continues for 30 ms until the electromagnetic clutch 41 is completely coupled (T13). In other words, the time Tp taken for the electromagnetic clutch 41 to be completely coupled and the motor load to return to a level close to the level before the clutch was turned on is about 30 ms.

During the period Tq of 50 to 100 ms (from T13 to T14) after the electromagnetic clutch 41 is completely coupled, there remain an oscillatory state in the motor load because of the resilient property of the load unit 43 and the electromagnetic clutch 41.

The motor load after this period is slightly greater than when the electromagnetic clutch was not connected, i.e., in the off state, because the paper sheet 21 is conveyed by the conveying roller pair 25. However, such increase DL in the motor load is slight because it is due to the increase in the pressure between the conveying roller pair 25 due to the fact that the paper sheet 21 is held between the conveying roller pair 25 and the friction force of the paper sheet 21 with the pick-up roller 23, the retard roller 24A, and the feed roller 24B. The output torque to be generated by the motor unit 40, i.e., the motor torque, need not be of a larger value (to an appreciable degree) after the oscillation following the motor load increase at the time of the connection of the electromagnetic clutch 41 is stabilized.

For this reason, upon the elapse of a time length Tw of 200 ms after the electromagnetic clutch 41 is turned on, the voltage of the motor current setting signal S3 from the CPU 47 is returned to an original level V1 (at T15 as shown in FIG. 4C), so that the motor current is returned to the normal current value.

The drive current varying means for the motor unit 40 is next described.

In the present embodiment, a current sensing resistor 48 is connected to the motor drive circuit 45 to sense the drive current of the motor unit 40, as shown in FIG. 1.

The driver 45*c* is shown to be connected with the motor unit 40 by a single line, but actually drive currents of different phases are supplied to coils of respective phases provided in the motor unit 40, via a plurality of conductors, not specifically illustrated as such. Based on the pulse periods determined by the PWM controller 45*b*, the driver 45*c* determines the currents for the respective phases, and the polarities of the voltages applied to the coils of the respective phases are switched in accordance with the phase signal S2 supplied from the CPU 47.

A current (which is also a "drive current") corresponding to the drive currents supplied for the motor unit 40 is drawn from the drive power source voltage terminal DP, and is passed through the driver 45*c* and through the current sensing resistor 48. The current through the current sensing resistor 48 is converted to a voltage, which is input, as a motor current sensing signal S4, to the comparator 45*a* in the motor drive circuit 45.

Also input to the comparator 45*a* is the current setting reference voltage signal S3, supplied as a voltage signal for controlling the motor current from the CPU 47. The comparator 45*a* compares the motor current sensing signal S4 from the current sensing resistor 48 with the current setting reference voltage signal S3 from the CPU 47. A signal S11 indicating the result of the comparison is passed to the PWM controller 45*b*. The PWM controller 45*b* performs the following operation based on the result of the comparison. The result of the comparison is represented by the following inequalities:

(motor current sensing signal S4) >(current setting reference voltage signal S3) (2)

(motor current sensing signal S4) <(current setting reference voltage signal S3) (3)

When the inequality (2) is satisfied, i.e., when the motor current value is larger than the set value, the PWM controller 45*b* reduces the on-duty of the PWM. When the inequality (3) is satisfied, i.e., when the motor current value is smaller than the set value, the PWM controller 45*b* increases the on-duty of the PWM.

The motor current is increased when the on-duty of the PWM is increased. The motor current is decreased when the on-duty of the PWM is decreased. Accordingly, the drive current supplied to the motor unit 40 is kept constant according to the current setting reference voltage signal S3. To increase the motor current, the current setting reference voltage signal S3 is set to be a larger value. To decrease the motor current, the current setting reference voltage signal S3 is set to be a smaller value.

The drive control performed by the program A1 is next described.

Figure 5A:
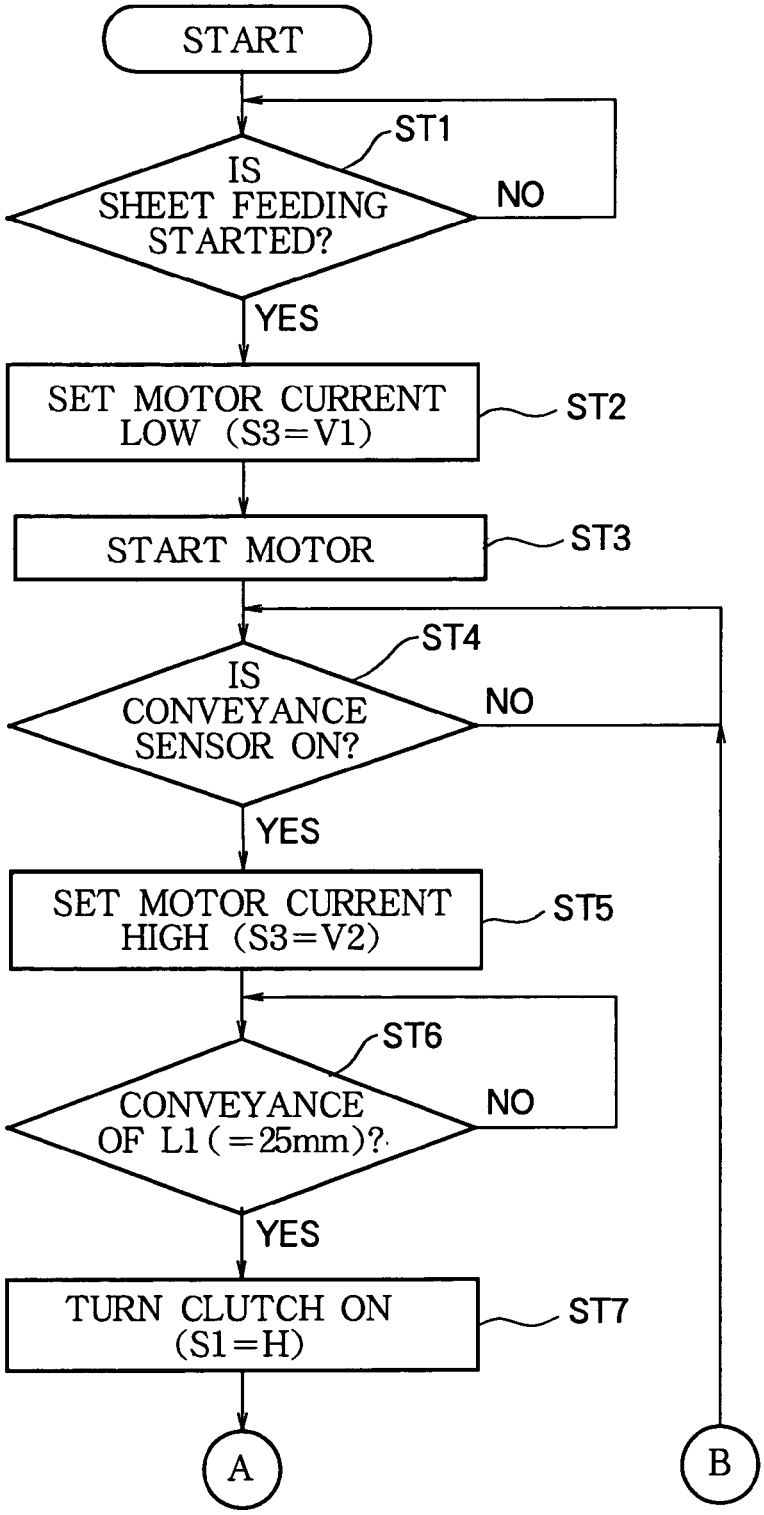
FIGS. 5A and 5B are flowcharts showing the operation of the driving control according to the first embodiment of the invention.
Figure 5B:
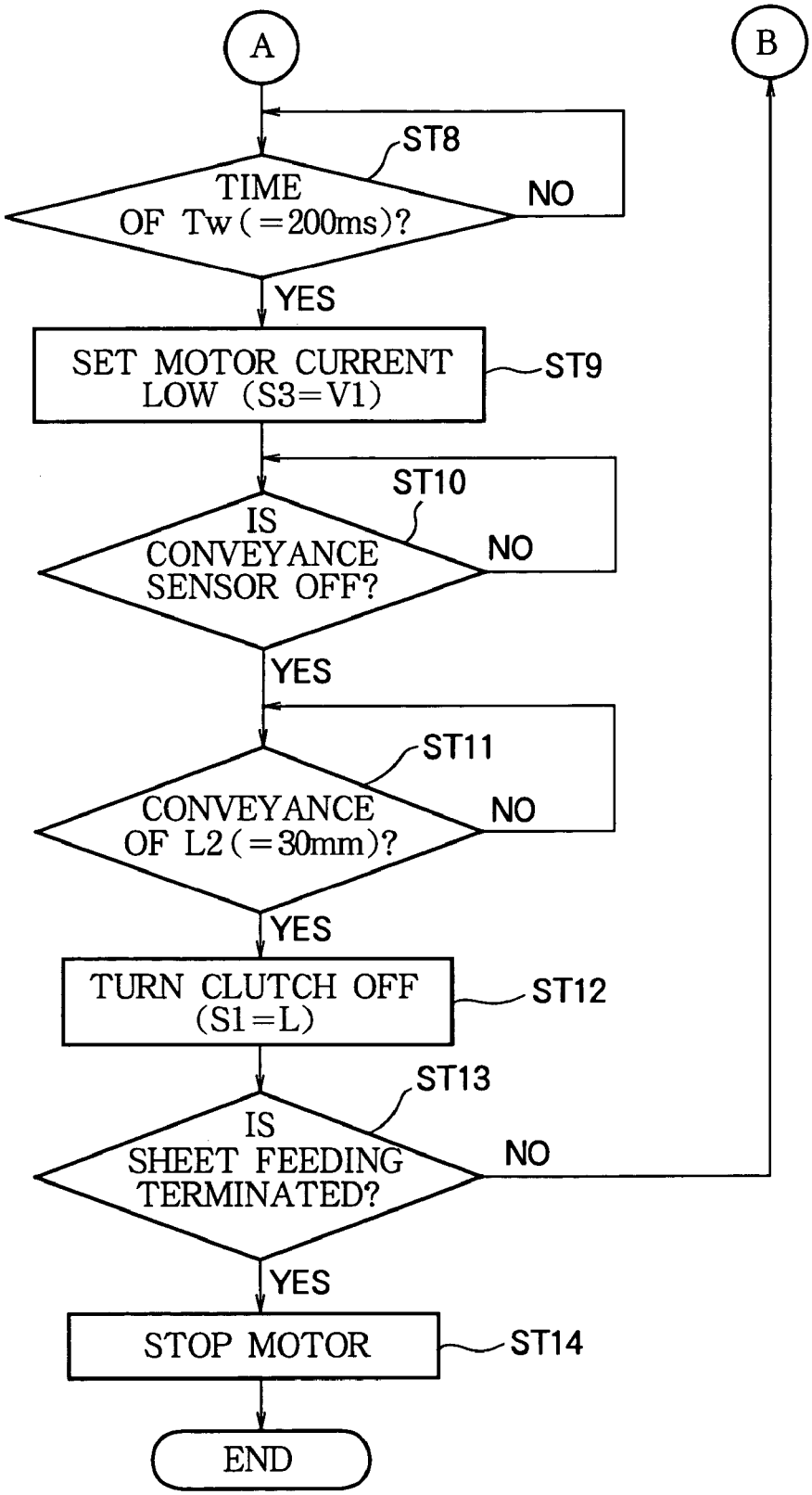

FIGS. 5A and 5B are flowcharts showing the operation of the drive control according to the first embodiment of the invention.

The CPU 47 repeats judgment on whether sheet feeding has begun. If it judges that the sheet feeding has begun, the CPU 47 sets the voltage of the current setting reference voltage signal S3 (which is an output of the CPU 47) to the level V1, in order to set the drive current supplied to the motor unit 40 to a normal, low level, i.e., small level. As a result, the motor current is set to a small value. Then, the motor starting action is taken to start the motor unit 40. In this case, a phase signal S2 with acceleration processing in conformity with the increase of the rotation speed required by the motor unit 40 is output.

The CPU 47 then judges whether the paper sheet 21 having been fed has reached the position of the conveyance sensor 28, i.e., whether the conveyance sensor 28 detects a paper sheet 21 (i.e., whether the output signal S5 of the conveyance sensor 28 is "turned on." When the output signal S5 of the conveyance sensor 28 is turned on (T11 in FIG. 4D), the voltage of the current setting reference voltage signal S3 is set to the level V2 (T11 in FIG. 4C), in order to set the motor current to a larger value, as a process for increasing the drive current supplied to the motor unit 40.

The CPU 47 then starts to monitor (e.g., by repeated calculation of, or by measuring the elapsed time) the distance of the sheet conveyance (distance the sheet has traveled after the leading edge of the paper sheet 21 has reached the position of the conveyance sensor 28) based on the timing at which the output signal S5 of the conveyance sensor 28 is turned on, and judges whether the distance of the sheet conveyance has reached a predetermined value L11, which in this example is set to be 25 mm, i.e., whether the paper sheet 21 has been conveyed for a distance of L11=25 mm. When the distance of sheet conveyance has reached the predetermined value L11=25 mm, the electromagnetic clutch 41 is turned on (T12 in FIG. 4A). In order to turn on the electromagnetic clutch 41, the clutch ON/OFF signal S1 is set to "high."

The CPU 47 then starts to monitor the time after the electromagnetic clutch 41 is turned on, and judges whether the time having elapsed after the turn-on of the electromagnetic clutch 41 has reached a predetermined time length Tw=200 ms. If the predetermined time length Tw=200 ms has elapsed, the CPU 47 sets the voltage of the current setting reference voltage signal S3 to the level V1 (T15, in FIG. 4C), in order to set the motor current to a smaller value, as an action to reduce the drive current supplied to the motor unit 40.

The CPU 47 then judges whether the trailing edge of the paper sheet 21 having been fed has passed the position of the conveyance sensor 28, i.e., whether the output signal S5 of the conveyance sensor 28 is turned off. If the output signal S5 of the conveyance sensor 28 is turned off (T16 in FIG. 4D), the CPU 47 starts to monitor the distance of the sheet conveyance after the trailing edge of the paper sheet 21 has passed the position of the conveyance sensor 28 based on the timing at which the output signal S5 of the conveyance sensor 28 is turned off, and judges whether the distance of the sheet conveyance after the turn-off of the output signal S5 of the conveyance sensor 28 has reached another predetermined value L13=30 mm, i.e., whether the paper sheet 21 has been conveyed for a distance L13=30 mm. If the sheet conveyance distance has reached L13=30 mm, the clutch ON/OFF signal S1 is set to "low" (T17 in FIG. 4A), so as to turn off the electromagnetic clutch 41.

The CPU 47 then judges whether the sheet feeding is terminated. If the sheet feeding is not terminated, the above described operation is repeated. If the sheet feeding is terminated, the motor-stopping action is taken, to stop the motor unit 40, so as to stop the processing.

Next the description is made referring to the flowchart.

Step ST1: Judgment is made as to whether the sheet feeding has been started. If the sheet feeding has been started, the next step performed is the step ST2. If the sheet feeding has not been started, "waiting" action is continued.

Step ST2: The voltage of the current setting reference voltage signal S3, which is an output signal from the CPU 47, is set to the level V1, in order to set the drive current of the motor unit 40 to a small level.

Step ST3: The motor unit 40 is started.

Step ST4: Judgment is made as to whether the output signal S5 of the conveyance sensor 28 is turned on. When the output signal S5 of the conveyance sensor 28 is turned on, the next step performed is the step ST5. If the output signal S5 of the conveyance sensor 28 is not on, the "waiting" action is continued.

Step ST5: The voltage of the current setting reference voltage signal S3, which is an output signal of the CPU 47, is set to the level V2, in order to set the drive current of the motor unit 40, to a large level.

Step ST6: Judgment is made as to whether the paper sheet 21 has been conveyed for a distance of L11=25 mm from the state (time point) when the output signal S5 of the conveyance sensor 28 is turned on. If the paper sheet 21 has been conveyed for L11=25 mm, the next step performed is the step ST7. If the paper sheet 21 has not been conveyed for L11=25 mm, the "waiting" action is continued.

Step ST7: The clutch ON/OFF signal S1 is set to "high" (H) to turn on the electromagnetic clutch 41.

Step ST8: Judgment is made as to whether the time length Tw of 200 ms has elapsed after the electromagnetic clutch 41 is turned on. If the time length of Tw=200 ms has elapsed, the next step performed is the step ST9. If the time length of Tw=200 ms has not elapsed, the "waiting" action is continued.

Step ST9: The voltage of the current setting reference voltage signal S3, which is an output signal of the CPU 47, is set to the level V1, in order to set the drive current of the motor unit 40 to a small level.

Step ST10: Judgment is made as to whether the output signal S5 of the conveyance sensor 28 has been turned off. If the output signal S5 of the conveyance sensor 28 has been turned off, the next step performed is the Step ST11. If the output signal S5 of the conveyance sensor 28 has not been turned off, the "waiting" action is continued.

Step ST11: Judgment is made as to whether the paper sheet 21 has been conveyed for the distance of L13=30 mm after the turn-off of the output signal S5 of the conveyance sensor 28. If the paper sheet 21 has been conveyed for the distance of L13=30 mm, the next step performed is the step ST12. If the paper sheet 21 has not been conveyed for the distance of L13=30 mm, the "waiting" action is continued.

Step ST12: The clutch ON/OFF signal S1 is set to "low" (L) to turn off the electromagnetic clutch 41.

Step ST13: Judgment is made as to whether the sheet feeding has been terminated. If the sheet feeding has been terminated, the next step performed is the step ST14. If the sheet feeding has not been terminated, the procedure returns to the step ST4.

Step ST14: The motor unit 40 is stopped to terminate the process.

As has been described, according to the present embodiment, the drive current supplied to the motor unit 40 is increased before the electromagnetic clutch 41 is turned on, and after the electromagnetic clutch 41 is turned on, the drive current supplied to the motor unit 40 is returned to a smaller value. As a result, the motor unit 40 does not pull out even when the load on the motor unit 40 is increased due to the inertia of the load unit 43, at the time when the electromagnetic clutch 41 is turned on.

Moreover, the drive current is returned to a small value after the electromagnetic clutch 41 is turned on, so that the drive current can be kept to be a small value except for a short period during which the electromagnetic clutch 41 is turned on, and the load on the motor unit 40 increases. Accordingly, it is possible to prevent excessive torque state during normal driving, thereby preventing oscillation and noises of the motor unit 40 from becoming large, and preventing wear of the gears from becoming fast.

It is also possible to reduce heating of the motor unit 40 and the motor drive circuit 45.

A second embodiment of the invention will now be described. Members identical to those in the first embodiment are denoted by the same reference numerals, and their description is omitted. Description of the operation and effects which are identical to those of the first embodiment is also omitted.

Figure 6:
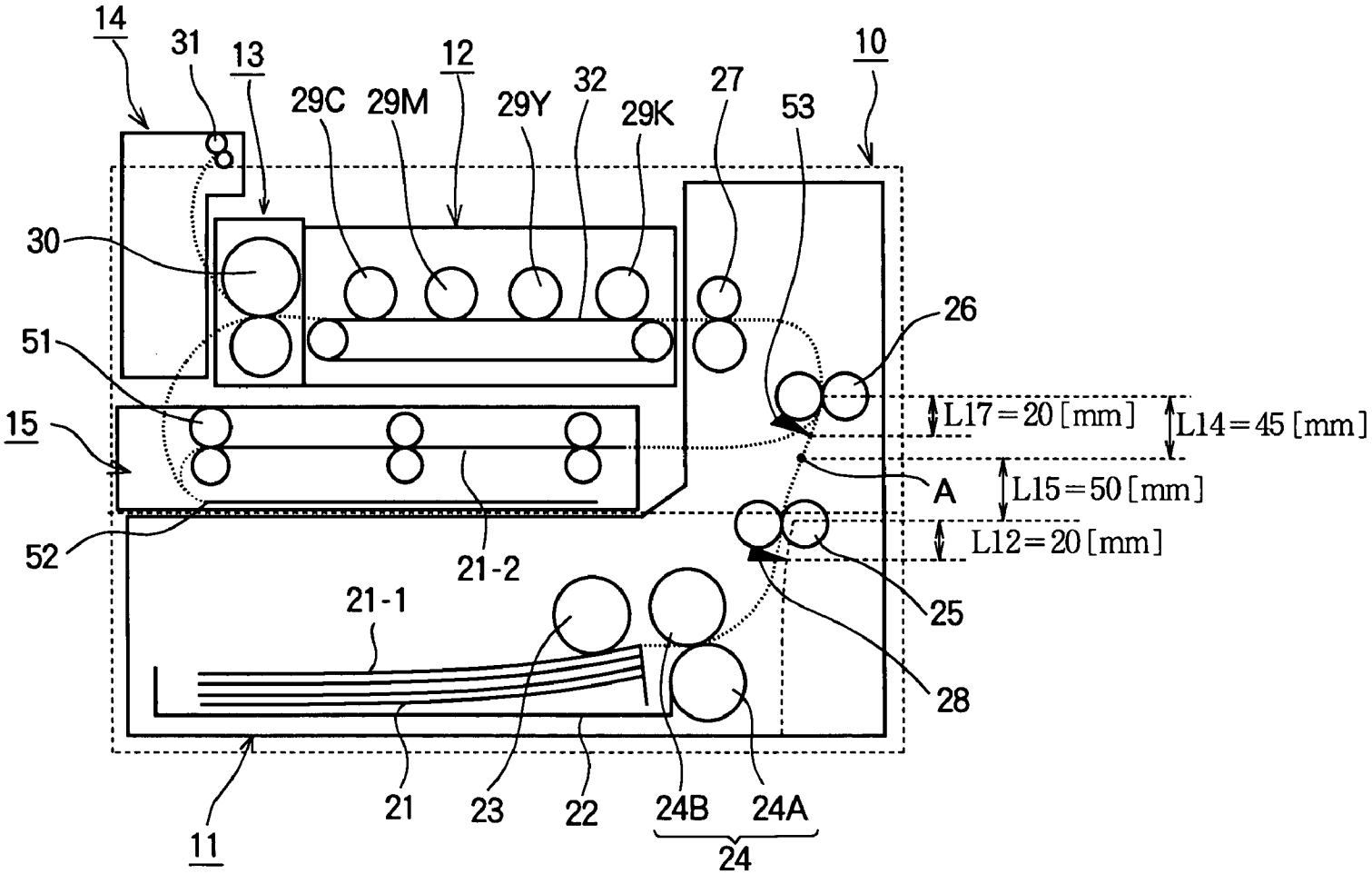
FIG. 6 is a schematic diagram of an image forming apparatus according to the second embodiment of the invention.
Figure 7:
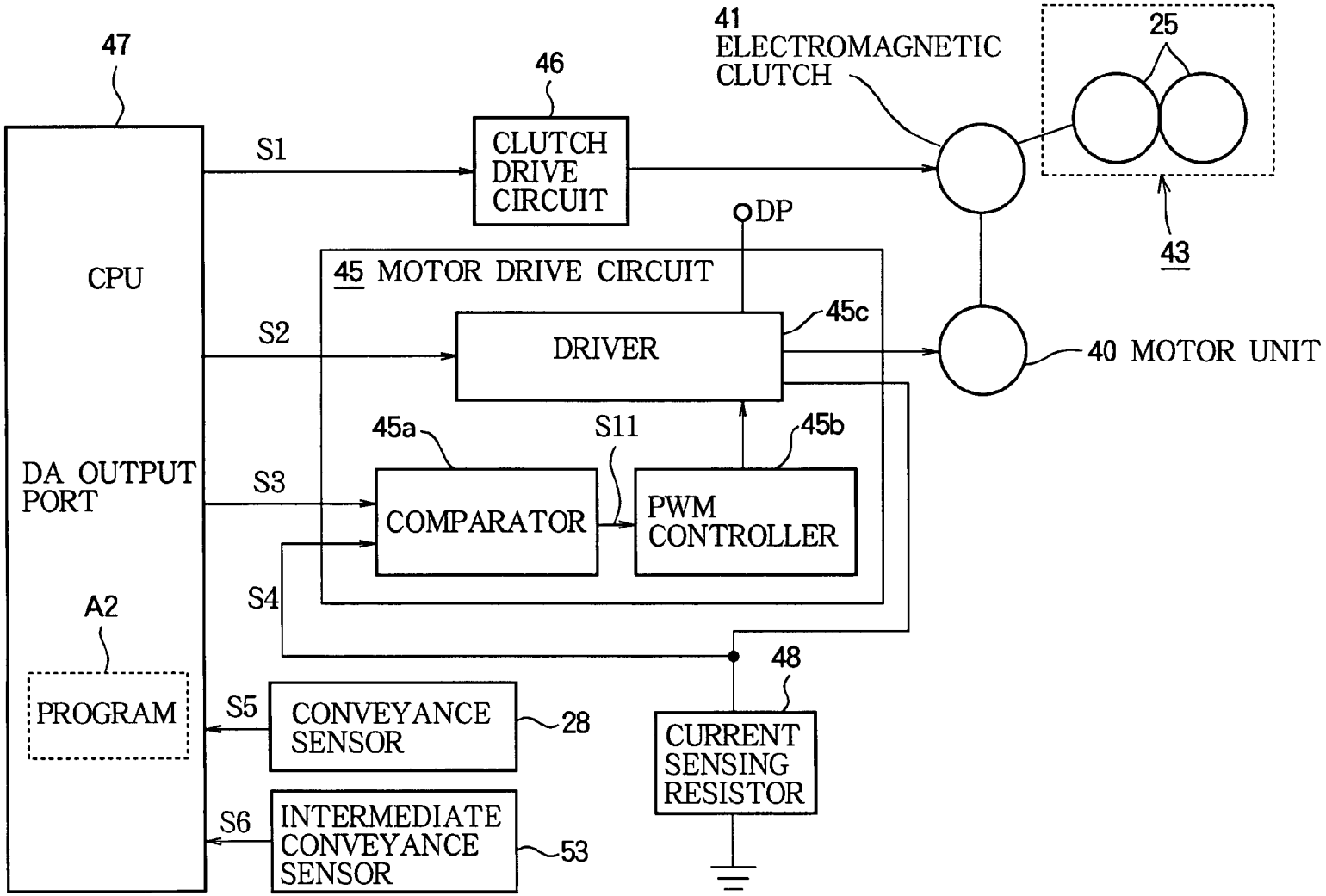
FIG. 7 is a circuit block diagram of the driving apparatus according to the second embodiment of the invention.

FIG. 6 is a schematic view of the image forming apparatus according to the second embodiment of the invention. FIG. 7 is a circuit block diagram of a driving apparatus according to the second embodiment of the invention.

A printer 10 according to the present embodiment is provided with a sheet reversing unit 15 for reversing the paper sheet 21. The sheet reversing unit 15 comprises a paper sheet retracting route 52 for reversal, and a roller pair 51 for conveying the paper sheet 21 after the reversal. Provided on the upstream side of the intermediate conveying roller pair 26 is an intermediate conveyance sensor 53. The output signal S6 from the intermediate conveyance sensor 53 is input to the CPU 47.

The driving apparatus according to the present embodiment has a configuration shown in FIG. 7. As shown, the CPU 47 performs control over the entire driving apparatus, i.e., the drive control according to the program A2 stored in the CPU 47 (i.e., in a program memory not shown as such). Input to the CPU 47 is the output signal S6 from the intermediate conveyance sensor 53.

The rest of the configuration is identical to that of the first embodiment, and its description is omitted.

The operation of the driving apparatus according to the second embodiment is now described.

FIGS. 8A to 8E are time charts showing the operation of the driving apparatus according to the second embodiment.

The conveying operation for conveying the paper sheet 21 during the printing is first described.

The paper sheet 21 accommodated in the sheet feeding unit 11 are picked up and fed out by the sheet pick-up roller 23 in the sheet feeding unit 11. When two or more paper sheets 21 are picked up simultaneously and fed out, overlapping each other, they are separated into each sheet by the separating unit 24. The paper sheet 21 is then conveyed toward the conveying roller pair 25. The conveying roller pair 25 is stationary before the paper sheet 21 arrives at the position of the conveying roller pair 25. The conveying roller pair 25 starts to rotate when the paper sheet 21 travels a predetermined distance after the paper sheet 21 is detected by the sensor 28, i.e., when the paper sheet 21 abuts on the conveying roller pair 25. Any skew of the paper sheet 21 is thereby corrected.

The paper sheet 21 is further conveyed by the intermediate conveying roller pair 26 and the registration roller pair 27 to the toner image forming unit 12. The toner image forming unit 12 forms toner images of black, yellow, magenta and cyan, on the paper sheet 21 by means of the black, yellow, magenta and cyan image forming units 29K, 29Y, 29M and 29C, while conveying the paper sheet 21 by means of the sheet conveying belt 32.

The paper sheet 21 on which the toner images have been formed is conveyed to the fixing unit 13, where heat and pressure are applied by means of the fixing roller 30, so that the toner images are fixed on the paper sheet 21.

When duplex printing (printing on both sides of a paper sheet) is not performed, the paper sheet 21 on which the toner images have been fixed is conveyed to the sheet discharge unit 14, and discharged or ejected, by means of the discharge roller 31, to the discharging tray on top of the printer.

When duplex printing is performed, in order not to lower the printing speed, the paper sheets 21 are fed out from the sheet feeding unit 11 one after another, in succession, and the paper sheets 21 re-fed from the sheet reversing unit 15 and the paper sheets 21 fed from the sheet feeding unit 21 need to be alternately fed to the intermediate conveying roller pair 26. For this reason, when the paper sheet 21 re-fed from the sheet reversing unit 15 is fed to the intermediate conveying roller pair 26, the paper sheet 21 fed from the sheet feeding unit 11 is halted at a position PA (upstream of the intermediate conveying roller pair 26 and downstream of the conveying roller pair 25) as shown in FIG. 6. In the example shown in FIG. 6, the distance L14 from the position PA to the intermediate conveying roller pair 26 is 45 mm, and the distance L15 from the conveying roller pair 25 to the position PA is 50 mm. When the paper sheet 21 re-fed from the sheet reversing unit 15 has passed the intermediate conveying roller pair 26, conveyance of the paper sheet 21 fed from the sheet feeding unit 11 is re-started or resumed.

The operation of the conveying roller pair 25 is next described. Here, in order to distinguish the paper sheet 21 fed from the sheet feeding unit 11 and the paper sheet 21 re-fed from the sheet reversing unit 15 from each other, the paper sheet 21 fed from the sheet feeding unit 11 is identified as paper sheet 21-1, and the paper sheet 21 re-fed from the sheet reversing unit 15 is identified as paper sheet 21-2. When it is not necessary to distinguish them, the paper sheet is referred to as paper sheet 21.

After the paper sheet 21-1 conveyed from the sheet feeding unit 11 is made to abut on the conveying roller pair 25, the electromagnetic clutch 41 is turned (T12) on to convey the paper sheet 21-1, and upon elapse of time of Tw=200 ms after the electromagnetic clutch 41 is turned on, the value of the motor current is switched to a low level (T15), as in the first embodiment.

As shown in FIGS. 8A to 8E, after the electromagnetic clutch 41 is turned on (T12) and the calculated distance of the conveyance of the paper sheet 21-1 has reached L16=50 mm (T22), judgment is made as to whether paper sheet 21-2 re-fed from the sheet reversing unit 15, i.e., reversed and re-fed paper sheet is present at the intermediate conveying roller pair 26. This judgment is made based on the output signal S6 of the intermediate conveyance sensor 53, and the calculated distance of conveyance of the re-fed paper sheet 21-2 after the trailing edge of the re-fed paper sheet 21-2 has passed the position of the intermediate conveyance sensor 53. If the paper sheet 21-2 is being detected by the intermediate conveyance sensor 53, the re-fed paper sheet 21-2 is found to be present. If the re-fed paper sheet 21-2 is not being detected by the intermediate conveyance sensor 53, but the calculated distance of conveyance of the re-fed paper sheet 21-2 after the trailing edge of the re-fed paper sheet 21-2 has passed the position of the intermediate conveyance sensor 53 is not more than a predetermined value, L18=25 mm, the re-fed paper sheet 21-2 is found to be present. In the example shown in FIG. 6, the distance L17 along the sheet conveyance path from the intermediate conveyance sensor 53 to the intermediate conveying roller pair 26 is 20 mm. This is why the re-fed paper sheet 21-2 is judged to be present if the calculated distance (the distance as calculated by the CPU 47) of the sheet conveyance after the trailing edge of the re-fed paper sheet 21-2 was detected to have passed the intermediate conveyance sensor 53 is not more than L18=25 mm which is the sum of L17=20 mm and a margin of 5 mm.

If the re-fed paper sheet 21-2 is judged to be not present, the operation similar to that of the first embodiment is performed. If the re-fed paper sheet 21-2 is judged to be present, the electromagnetic clutch 41 is turned off (at T22 as shown in FIG. 8A), and the conveyance of the paper sheet 21-1 is halted.

As was described in connection with the first embodiment, when the drive current value of the motor unit 40 is increased, the output torque is increased suddenly, so that the rotation of the motor unit 40 becomes oscillatory. For this reason, when the load on the motor unit 40 increases at this timing, the motor unit 40 may be out of synchronization, and may pull out. It is therefore desirable that the electromagnetic clutch 41 is not turned on until after the oscillation of the motor unit 40, due to the increase of the drive current of the motor unit 40, is stabilized. Usually, the time Ts taken for the oscillation of the motor unit 40 to be stabilized is 50 to 100 ms.

The present embodiment utilizes the result of the detection of the paper sheet 21-2 re-fed to the intermediate conveyance sensor 53 to simplify the control over timing at which the electromagnetic clutch 41 is turned on.

Figures 8A, 8B, 8C, 8D, 8E:
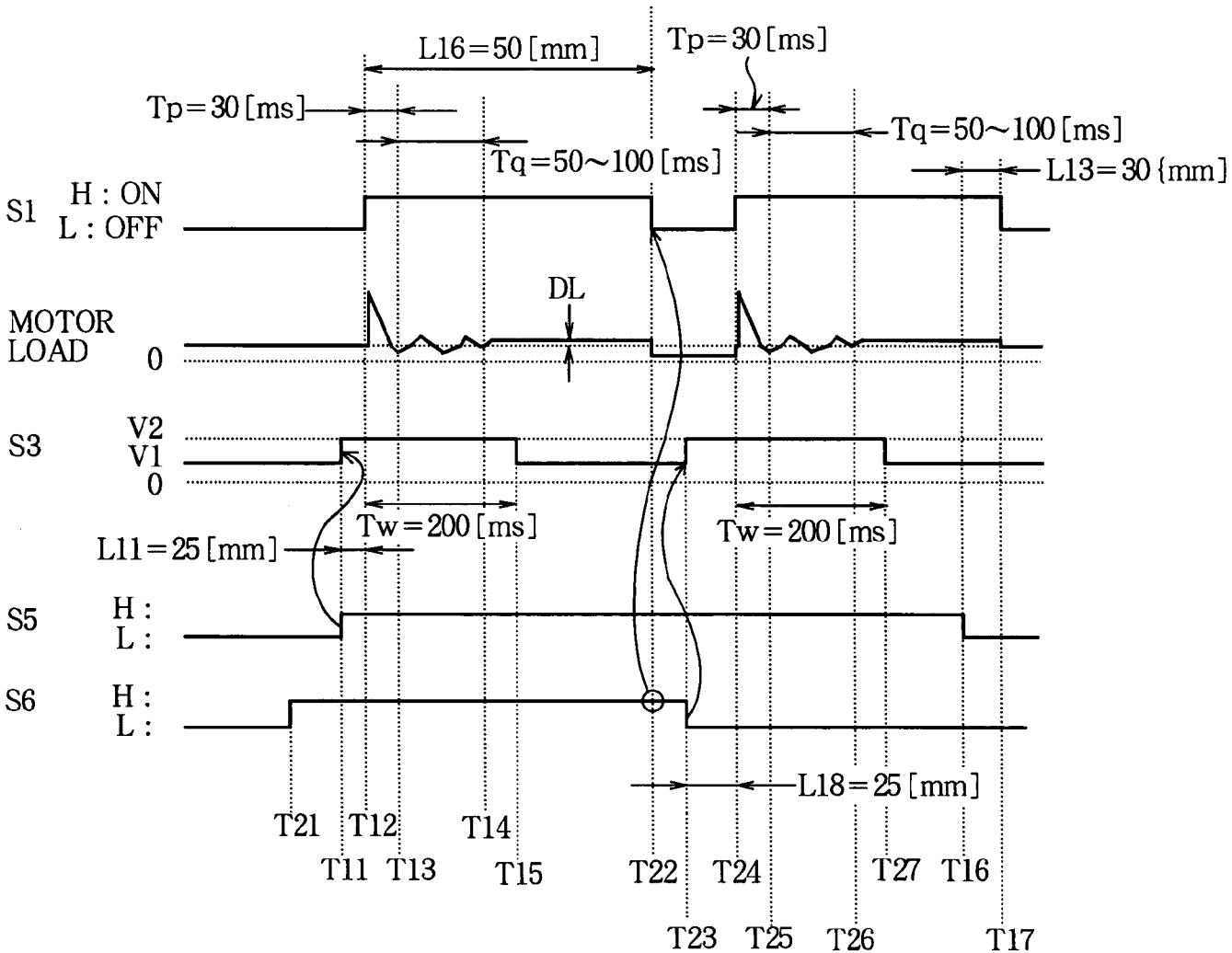
FIGS. 8A to 8E are time charts showing the operation of the driving apparatus according to the second embodiment of the invention.

When the trailing edge of the paper sheet 21-2 has passed the intermediate conveyance sensor 53 at T23 as shown in FIG. 8E, the voltage of the voltage signal S3 which is the current setting reference voltage signal, and serves as the motor current setting signal is raised to the level V2 at T23 as shown in FIG. 8C, to increase the drive current value of the motor unit 40. When the calculated distance of the sheet conveyance after the trailing edge of the re-fed paper sheet 21-2 is detected by the intermediate conveyance sensor 53 has reached a predetermined value L18 of 25 mm, the electromagnetic clutch 41 is turned on at T24 as shown in FIG. 8A, to re-start or resume the conveyance of the paper sheet 21-1. In the present embodiment, the conveyance speed of the paper sheet 21 is Vc=180 mm/s, and the time Tv required for the paper sheet 21 to travel the distance of L18=25 mm, which is the above-mentioned distance of sheet conveyance, is 139 ms (Tv=25 [mm]/180 [m/s]=139 ms). It is therefore possible to turn on the electromagnetic clutch 41 after the rotation of the motor unit 40 is stabilized.

The motor load at the time when the electromagnetic clutch 41 is turned on, is increased suddenly when the motor unit 40 is connected to the load unit 43, as shown in FIG. 8B, and as in the first embodiment. This is because of the inertia component of the conveying roller 25 of the load unit 43, and because the load unit 43 having been stationary begins to rotate and the rotation speed rises to the speed of the motor unit 40 within in a short period of time, upon turning-on of the electromagnetic clutch 41 and the resultant connection of the motor unit 40 with the load section 12. The high motor load continues for 30 ms until the electromagnetic clutch 41 is completely coupled (T25). In other words, the time Tp taken for the electromagnetic clutch 41 to be completely coupled and the motor load to return to a level close to the level before the clutch was turned on is about 30 ms.

During the period Tq of 50 to 100 ms (from T25 to T26) after the electromagnetic clutch 41 is completely coupled, there remain an oscillatory state in the motor load because of the resilient property of the load unit 43 and the electromagnetic clutch 41.

The motor load after this period is slightly larger than when the electromagnetic clutch was not connected, i.e., in the off state, because the paper sheet 21 is conveyed by the conveying roller pair 25. However, such increase DL in the motor load is slight because it is due to the increase in the pressure between the conveying roller pair 25 due to the fact that the paper sheet 21 is held between the conveying roller pair 25 and the friction force of the paper sheet 21 with the pick-up roller 23, the retard roller 24A, and the feed roller 24B. The output torque to be generated by the motor unit 40, i.e., the motor torque, need not be of a larger value (to an appreciable degree) after the oscillation following the motor load increase at the time of the connection of the electromagnetic clutch 41 is stabilized.

For this reason, upon the elapse of a time length Tw of 200 ms after the electromagnetic clutch 41 is turned on, the voltage of the motor current setting signal S3 from the CPU 47 is returned to the original level V1 (at T27 as shown in FIG. 8C), so that the motor current is returned to the normal current value.

The drive control performed by the program A2 is next described.

Figure 9A:
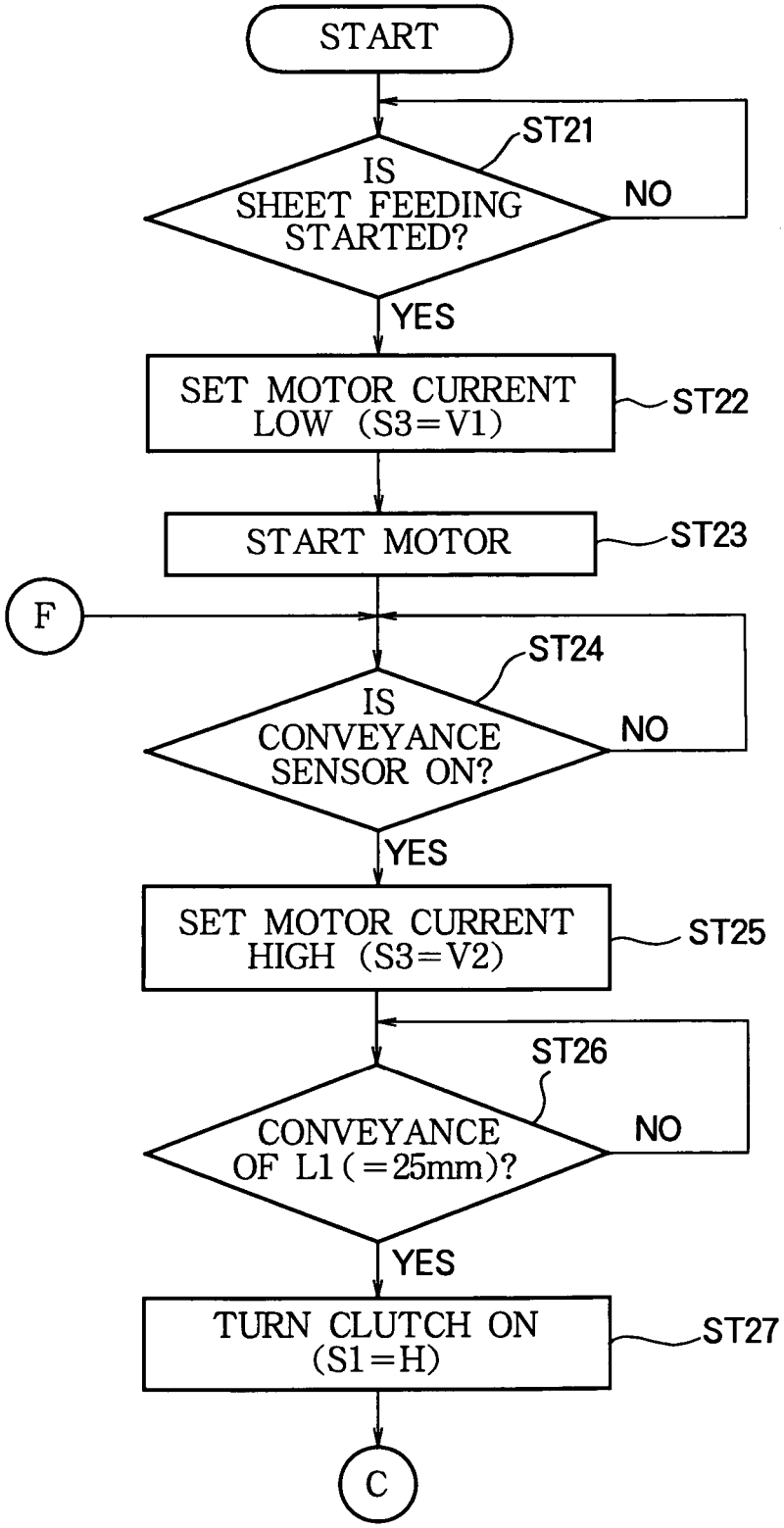
FIGS. 9A to 9C are flowcharts showing the operation of the driving control according to the second embodiment of the invention.
Figure 9B:
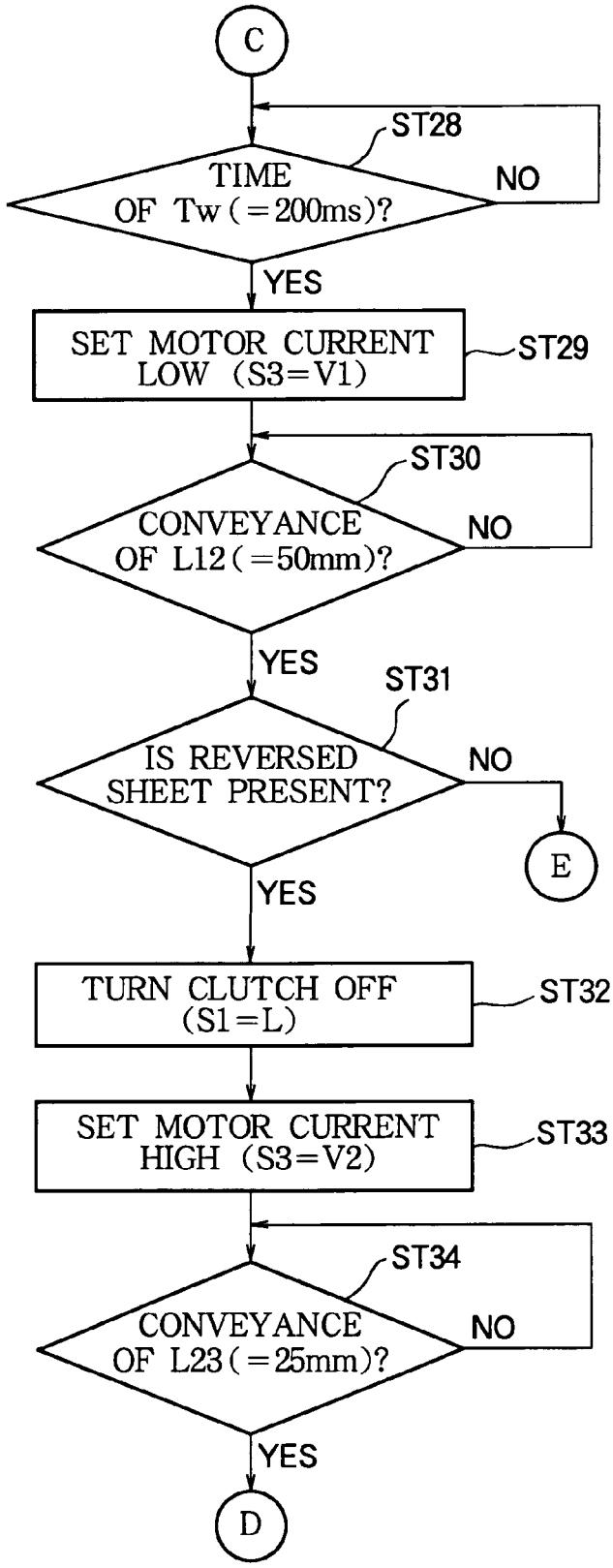
Figure 9C:
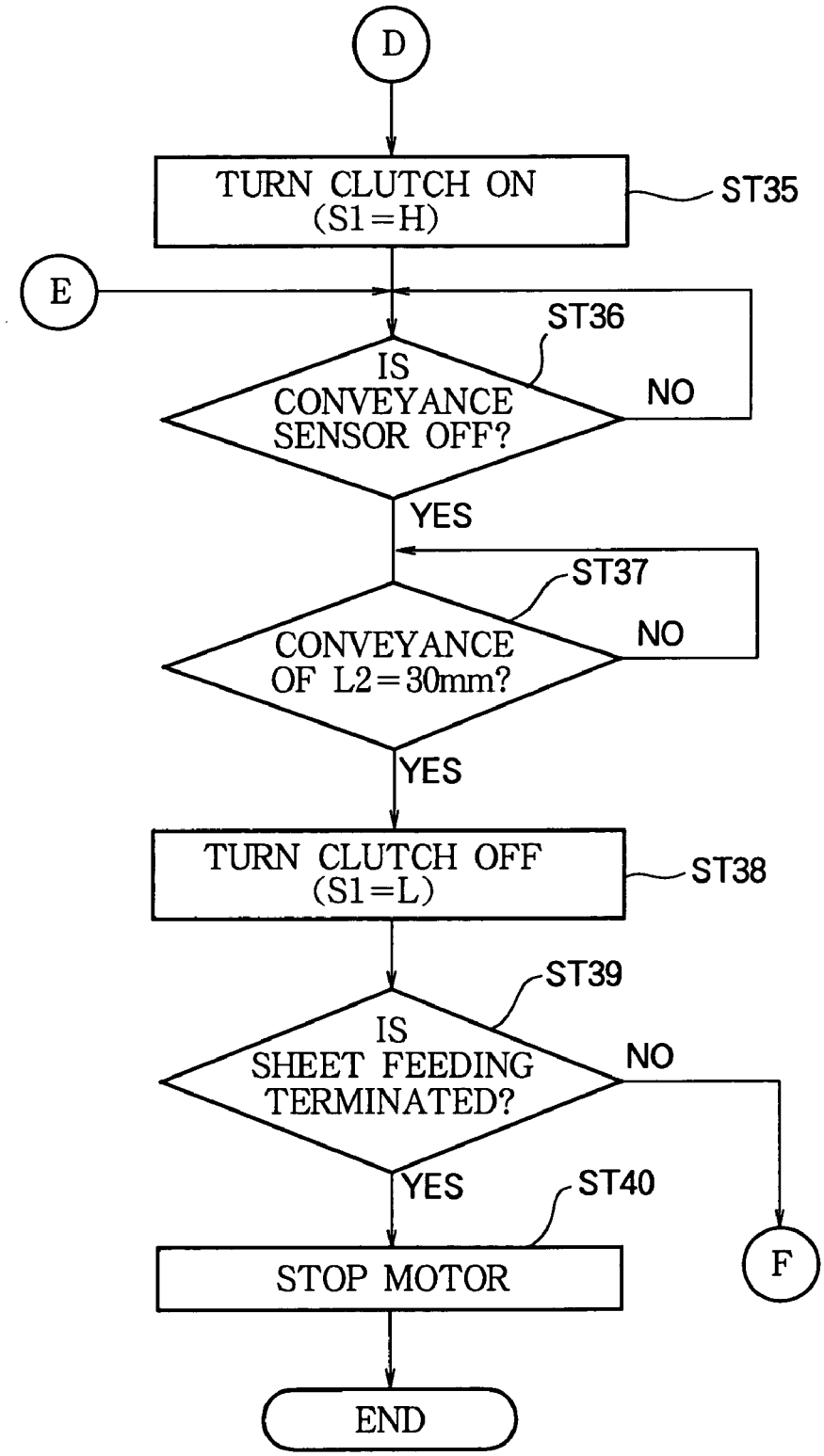

FIGS. 9A to 9C are flowcharts showing the operation of the drive control according to the second embodiment of the invention.

When the sheet feeding is started, the CPU 47 sets the voltage of the current setting reference voltage signal S3 to the level V1, and the motor unit 40 is made to start. When the output signal S5 of the conveyance sensor 28 is turned on (T11 in FIG. 8D), the voltage of the current setting reference voltage signal S3 is set to the level V2 (T11 in FIG. 8C). When the distance of the sheet conveyance has reached L11=25 mm, the electromagnetic clutch 41 is turned on (T12 in FIG. 8A), and the when the time of elapse after the electromagnetic clutch 41 is turned on has reached Tw=200 ms, the voltage of the current setting reference voltage signal S3 is set to the level V1 (T15 in FIG. 8C). The operation so far is identical to that of the first embodiment, so that only the outline has been set forth.

The CPU 47 then calculates the distance of sheet conveyance based on the timing at which the electromagnetic clutch 41 is turned on, and judges whether the distance of the sheet conveyance has reached L16=50 mm, i.e., whether the paper sheet 21 has been conveyed for a distance of L16=50 mm. If the distance of sheet conveyance has reached L16=50 mm, judgment is made as to whether the paper sheet 21-2 re-fed from the sheet reversing unit 15 is being detected by the intermediate conveyance sensor 53.

In the illustrated example, the output signal S6 of the intermediate conveyance sensor 53 is shown to be turned on at T21 before the output signal S5 of the conveyance sensor 28 is turned on at T11.

If the paper sheet 21-2 is being detected by the intermediate conveyance sensor 53, the CPU 47 switches the electromagnetic clutch 41 off (T22 in FIG. 8A). (In the illustrated example, the paper sheet 21-2 is assumed to be detected since a time point T21.) Subsequently, when the paper sheet 21-2 ceases to be detected by the intermediate conveyance sensor 53, at T23 in FIG. 8E, as a process for increasing the drive current of the motor unit 40, the voltage of the current setting reference voltage signal S3 is set to the level V2 (T23 in FIG. 8C), to set the motor current to a large value.

The CPU 47 then starts to monitor whether the trailing edge of the paper sheet 21-2 re-fed from the sheet reversing unit 15 has passed the sheet conveyance path. That is, judgment is made as to whether the paper sheet has traveled the distance of L18=25 mm after the intermediate conveyance sensor 53 ceases to detect the paper sheet 21-2. If the trailing edge of the paper sheet 21-2 has not been found to have passed the sheet conveyance path, the halting of the conveyance of the paper sheet 21-1 is continued. If the trailing edge of the paper sheet 21-2 has been found to have passed the sheet conveyance path, the electromagnetic clutch 41 is turned on (T24 in FIG. 8A), to resume the conveyance of the paper sheet 21-1.

The CPU 47 then starts to monitor whether the trailing edge of the paper sheet 21-1 has passed the position of the conveyance sensor 28, i.e., whether the output signal S5 of the conveyance sensor 28 is turned off.

Incidentally, when the paper sheet 21-1 has reached the position PA, judgment is made as to whether the paper sheet 21-2 re-fed from the sheet reversing unit 15 is on the sheet conveyance path, i.e., whether the paper sheet 21-2 has traveled the distance of L18=25 mm after the intermediate conveyance sensor 53 ceases to detect the paper sheet 21-2, and if the paper sheet 21-2 is not on the sheet conveyance path, the CPU 47 causes the conveyance of the paper sheet 21-1, and makes judgment as to whether the output signal S5 of the conveyance sensor 28 is turned off.

The operation after this is identical to that of the first embodiment, so that its description is omitted.

Description is made referring to the flowcharts.

Step ST21: Judgment is made as to whether the sheet feeding has been started. If the sheet feeding has been started, the next step performed is the step ST22. If the sheet feeding has not been started, "waiting" action is continued.

Step ST22: The voltage of the current setting reference voltage signal S3, which is an output signal from the CPU 47, is set to the level V1, in order to set the drive current of the motor unit 40 to a small level.

Step ST23: The motor unit 40 is started.

Step ST24: Judgment is made as to whether the output signal S5 of the conveyance sensor 28 is turned on. When the output signal S5 of the conveyance sensor 28 is turned on, the next step performed is the step ST25. If the output signal S5 of the conveyance sensor 28 is not on, the "waiting" action is continued.

Step ST25: The voltage of the current setting reference voltage signal S3, which is an output signal of the CPU 47, is set to the level V2, in order to set the drive current of the motor unit 40, to a large level.

Step ST26: Judgment is made as to whether the paper sheet 21 has been conveyed for a distance of L11=25 mm from the state (time point) when the output signal S5 of the conveyance sensor 28 is turned on. If the paper sheet 21 has been conveyed for L11=25 mm, the next step performed is the step ST27. If the paper sheet 21 has not been conveyed for L11=25 mm, the "waiting" action is continued.

Step ST27: The clutch ON/OFF signal S1 is set to "high" (H), to turn on the electromagnetic clutch 41.

Step ST28: Judgment is made as to whether the time length Tw of 200 ms has elapsed after the electromagnetic clutch 41 is turned on. If the time length of Tw=200 ms has elapsed, the next step performed is the step ST29. If the time length of Tw=200 ms has not elapsed, the "waiting" action is continued.

Step ST29: The voltage of the current setting reference voltage signal S3, which is an output signal of the CPU 47, is set to the level V1, in order to set the drive current of the motor unit 40 to a small level.

Step ST30: Judgment is made as to whether the paper sheet 21 has been conveyed the distance of L16=50 mm after the state (time point) at which the electromagnetic clutch 41 is turned on (T12). If the paper sheet 21 has been conveyed for the distance of L16=50 mm, the next step performed is step ST31. If the paper sheet 21 has not been conveyed for the distance of L16=50 mm, the "waiting" action is continued.

Step ST31: Judgment is made as to whether the paper sheet 21-2 re-fed from the sheet reversing unit 15 is present. If the re-fed paper sheet 21-2 is present, the next step performed is the step ST32. If the re-fed paper sheet 21-2 is not present, the next step performed is the step ST36.

Step ST32: The clutch ON/OFF signal S1 is set to "low" (L), to turn off the electromagnetic clutch 41 (T22 in FIG. 8A).

Step ST33: The voltage of the current setting reference voltage signal S3, which is an output signal from the CPU 47, is set to the level V2 (T23 in FIG. 8C), in order to set the drive current of the motor unit 40 to a large level.

Step ST34: Judgment is made as to whether the paper sheet 21-2 has been conveyed for the distance of L18=25 mm after the intermediate conveyance sensor 53 ceases to detect the paper sheet 21-2 (i.e., after the intermediate conveyance sensor 53 detects the passage of the trailing edge of the re-fed paper sheet 21-2). If the paper sheet 21-2 has been conveyed for the distance of L18=25 mm, the next step performed is the step ST35. If the paper sheet 21-2 has not been conveyed for the distance of L18=25 mm, the "waiting" action is continued.

Step ST35: The clutch ON/OFF signal S1 is set to "high" (H), to turn on the electromagnetic clutch 41 (T24 in FIG. 8A).

Step ST36: Judgment is made as to whether the output signal S5 of the conveyance sensor 28 has been turned off. If the output signal S5 of the conveyance sensor 28 has been turned off, the next step performed is the Step ST37. If the output signal S5 of the conveyance sensor 28 has not been turned off, the "waiting" action is continued.

Step ST37: Judgment is made as to whether the paper sheet 21 has been conveyed for the distance of L13=30 mm after the turn-off of the output signal S5 of the conveyance sensor 28. If the paper sheet 21 has been conveyed for the distance of L13=30 mm, the next step performed is the step ST38. If the paper sheet 21 has not been conveyed for the distance of L13=30 mm, the "waiting" action is continued.

Step ST38: The clutch ON/OFF signal S1 is set to "low" (L), to turn off the electromagnetic clutch 41.

Step ST39: Judgment is made as to whether the sheet feeding has been terminated. If the sheet feeding has been terminated, the next step performed is the step ST40. If the sheet feeding has not been terminated, the procedure returns to the step ST24.

Step ST40: The motor unit 40 is stopped to terminate the process.

As has been described, according to the present embodiment, the drive current supplied to the motor unit 40 is increased before the electromagnetic clutch 41 is turned on, and after the electromagnetic clutch 41 is turned on, the drive current supplied to the motor unit 40 is returned to a smaller value. As a result, the motor unit 40 does not pull out even when the load on the motor unit 40 is increased due to the inertia of the load unit 43, at the time when the electromagnetic clutch 41 is turned on.

Moreover, the drive current is returned to a small value after the electromagnetic clutch 41 is turned on, so that the drive current can be kept to be a small value except for a short period during which the electromagnetic clutch 41 is turned on, and the load on the motor unit 40 increases. Accordingly, it is possible to prevent excessive torque state during normal driving, thereby preventing oscillation and noises of the motor unit 40 from becoming large, and preventing wear of the gears from becoming fast.

It is also possible to reduce heating of the motor unit 40 and the motor drive circuit 45.

In the first and second embodiments, the image forming apparatus is a printer. The invention can be applied to facsimile machine, MFP (multi function printer), copier, other types of electronic devices having similar driving apparatus.

The invention is not limited to the embodiments described, but it is possible alter the arrangement without departing the scope and spirit of the invention.

What is claimed is:

1. A driving apparatus comprising:

(a) a drive source outputting a drive force;

(b) a drive force interruption/transmission device for transmitting or interrupting the drive force from the drive source;

(c) a load unit operating by the drive force transmitted from the drive force interruption/transmission device;

(d) a torque control unit for varying the output torque of the drive source;

(e) a drive force interruption control unit for controlling the operation of the drive force interruption/transmission device; and (f) a drive timing control unit for controlling the torque control unit and the drive force interruption/transmission control unit;

wherein said torque control unit comprises a drive circuit for controlling the current of the drive source, and after the drive circuit has increased the current of the drive source from a first current value for causing the drive source to generate a first output torque, to a second current value for causing the drive source to generate a second output torque higher than the first output torque, the drive force interruption/transmission device transmits the drive force from the drive source to the load unit.

2. The driving apparatus according to claim 1, wherein said drive source is a stepping motor.

3. The driving apparatus according to claim 1, wherein said load unit is a medium conveying device.

4. The driving apparatus according to claim 1, wherein upon expiration of a predetermined time after the drive force interruption/transmission device starts to transmit the drive force to the load unit, after the increase to the first current value, the output torque of the drive source is reduced to the first output torque.

5. The driving apparatus according to claim 2, wherein said load unit comprises a medium conveying device for conveying a medium; and while said drive force interruption/transmission device is transmitting the drive force to the load unit, and the medium conveying device is conveying the medium, said drive circuit reduces the current of the drive source from the second current value to the first current value.

6. A driving apparatus comprising:

(a) a drive source outputting a drive force;

(b) a drive force interruption/transmission device for transmitting or interrupting the drive force from the drive source;

(c) a medium conveying device for conveying a medium by means of the drive force transmitted from the drive force interruption/transmission device;

(d) a torque control unit for varying the output torque of the drive source;

(e) a drive force interruption control unit for controlling the operation of the drive force interruption/transmission device; and (f) a drive timing control unit for controlling the torque control unit and the drive force interruption/transmission control unit;

wherein the torque control unit comprises a drive circuit for controlling the current of the drive source, and after the drive circuit has increased the current of the drive source from a first current value for causing the drive source to generate a first output torque, to a second current value for causing the drive source to generate a second output torque higher than the first output torque, without changing the speed of the drive source, the drive force interruption/transmission device transmits the drive force from the drive source to the medium conveying device, and while the drive force interruption/transmission device is transmitting the drive force from the drive sorce to the medium conveying device and the medium conveying device is conveying the medium, the drive circuit decreases the current from the second current value to the first current value to reduce the output torque from the second output torque to the first output torque, without changing the speed of the drive source.

7. The driving apparatus according to claim 6, wherein upon expiration of a predetermined time after the drive force interruption/transmission device starts to transmit the drive force to the medium conveying device, after the increase to the first current value, the drive circuit reduces the current of the drive source to the first current value.

* * * * *

UNITED STATES PATENT AND TRADEMARK OFFICE

CERTIFICATE OF CORRECTION

PATENT NO. : 7,571,907 B2
APPLICATION NO. : 11/378862
DATED : August 11, 2009
INVENTOR(S) : Hideki Shinyama It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 516 days.

Signed and Sealed this

Seventh Day of September, 2010

David J. Kappos

David J. Kappos
*Director of the United States Patent and Trademark Office*